US007370494B2

(12) United States Patent
Jaouani et al.

(10) Patent No.: US 7,370,494 B2
(45) Date of Patent: May 13, 2008

(54) METHOD AND INSTALLATION FOR PRODUCING, IN GASEOUS FORM AND UNDER HIGH PRESSURE, AT LEAST ONE FLUID CHOSEN FROM OXYGEN, ARGON AND NITROGEN BY CRYOGENIC DISTILLATION OF AIR

(75) Inventors: Lasad Jaouani, Bobigny (FR); Bao Ha, San Ramon, CA (US); Ovidiu Balog, Arles (FR); Maurice Grenier, Paris (FR); Xavier Pontone, Saint Maur des Fosses (FR)

(73) Assignee: L'Air Liquide, Societe Anonyme A Directoire et Conseil de Surveillance pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 11/487,928

(22) Filed: Jul. 17, 2006

(65) Prior Publication Data

US 2006/0254312 A1 Nov. 16, 2006

Related U.S. Application Data

(62) Division of application No. 10/779,381, filed on Feb. 13, 2004, now Pat. No. 7,076,971.

(30) Foreign Application Priority Data

Feb. 13, 2003 (FR) ..... 03 01722

(51) Int. Cl.
*F25J 3/00* (2006.01)

(52) U.S. Cl. ..... 62/645; 62/650; 62/652

(58) Field of Classification Search ..... 62/650, 62/643, 645, 649, 652
See application file for complete search history.

(56) References Cited

U.S. PATENT DOCUMENTS

| | | | | |
|---|---|---|---|---|
| 4,507,134 | A * | 3/1985 | Tomisaka | 62/647 |
| 4,617,036 | A * | 10/1986 | Suchdeo et al. | 62/652 |
| 4,833,171 | A | 5/1989 | Sweeney | |
| 4,834,785 | A * | 5/1989 | Ayres | 62/650 |
| 5,076,837 | A | 12/1991 | Rathbone et al. | |
| 5,635,541 | A | 6/1997 | Smith et al. | |
| 5,979,183 | A | 11/1999 | Smith et al. | |
| 6,282,901 | B1 | 9/2001 | Marin et al. | |
| 6,568,209 | B1 * | 5/2003 | Zimmer et al. | 62/643 |
| 6,871,513 | B2 | 3/2005 | Guillard | |
| 7,143,606 | B2 | 12/2006 | Tranier | |

FOREIGN PATENT DOCUMENTS

EP 0577349 A1 * 1/1994

* cited by examiner

*Primary Examiner*—William C Doerrler
(74) *Attorney, Agent, or Firm*—Elwood Haynes

(57) ABSTRACT

A process and apparatus for highly efficient production of industrial gases by the cryogenic distillation of air, wherein a feed stream of compressed air, is supercharged to high pressure, cooled, and mixed with various recycle streams of supercharged air, to regulate the expander turbine operating temperature. The need for pre-cooling equipment downstream of the supercharger, which is widely employed in industry to manage the temperature of the incoming compressed air stream, is eliminated.

21 Claims, 3 Drawing Sheets

METHOD AND INSTALLATION FOR PRODUCING, IN GASEOUS FORM AND UNDER HIGH PRESSURE, AT LEAST ONE FLUID CHOSEN FROM OXYGEN, ARGON AND NITROGEN BY CRYOGENIC DISTILLATION OF AIR

CROSS REFERENCE TO RELATED APPLICATIONS

This application is a divisional of application Ser. No. 10/779,381, filed on Feb. 13, 2004 now U.S. Pat. No. 7,076,971.

BACKGROUND

The present invention relates to a method of producing, in gaseous form and under high pressure, at least one fluid chosen from oxygen, argon and nitrogen, in which method air is distilled, the said fluid is brought in the liquid state to the high pressure, it is vaporized and warmed at this high pressure in the heat exchange line of the installation.

In the present specification, "high pressure" means a pressure greater than 10 bar in the case of oxygen, argon and nitrogen, and "blower" means a compressor having a single compression stage. Furthermore, the pressures in question are absolute pressures.

When producing oxygen, these methods, called "pumped" methods, have the advantage of dispensing with the oxygen compressor, which is a costly machine, poses serious reliability problems and has high maintenance costs.

EP-A-0 504 029 describes a method in which all the air is compressed to a high pressure in a blower, a portion of the high-pressure air is expanded in a Claude turbine (that is a Claude turbine which discharges into the medium-pressure column) and the rest of the air exchanges heat with the liquid oxygen in the process of vaporizing in the exchange line.

In this type of unit, it is desirable to have a means of preventing the inlet of the turbine becoming too cold, for example in the event of change of operation.

FR-A-2 688 052 describes a method in which:

- air in the process of cooling in the heat exchange line is extracted from the latter at an intermediate temperature close to the vaporization temperature of the said fluid, or to its pseudo-vaporization temperature if the high pressure is supercritical;
- this air is compressed in a blower;
- it is reintroduced into the heat exchange line and at least one expansion of a cycle gas is effected in a turbine.

EP-A-0 644 388 describes a method in which a portion of the air is compressed to the medium pressure and sent into the medium-pressure column of a double column while the rest of the air is supercharged at ambient temperature. A portion of the supercharged air is then compressed in a cold supercharger.

During the start-up of the units according to EP-A-0 644 388 and FR-A-2 688 052, the air extracted from the heat exchange line is at the inlet of the blower at ambient temperature due to the fact that there are very few cold gases that warm up in the exchange line. Following compression, it returns to a temperature that may be as high as 120° C., compared with the temperature of approximately −120° C. when the unit is in stable operation. This may damage the exchange line, which is not designed to withstand such high temperatures.

SUMMARY

An aim of the invention is to allow rapid start-up of the unit without risk of damage to the exchange line.

It is one object of the invention to provide a method of producing, in gaseous form and under high pressure, at least one fluid chosen from oxygen, argon and nitrogen in an air separation unit, in which all the air intended for distillation is compressed in a compressor, the compressed air is purified, at least a first portion of the air is supercharged to a high pressure, the compressed and purified air is sent into a heat exchange line of the installation where it cools, the compressed, purified and cooled air is separated in a system of columns of the installation comprising at least one distillation column, a fluid is withdrawn in the liquid state from one column of the system of columns, the said fluid in the liquid state is brought to the high pressure, it is vaporized by heat exchange with the air and the vaporized liquid at this high pressure is warmed in the heat exchange line of the installation, at least one portion of the supercharged air is expanded in an expansion turbine from the high pressure to a second pressure, the expanded air then being sent into one column of the system of columns, in normal operation the supercharged air being cooled down to the inlet temperature of the turbine in the exchange line upstream of the expansion turbine, characterized in that, during start-up of the air separation unit and/or in order to regulate the inlet temperature of the turbine, at least one portion of the air supercharged to the high pressure is sent upstream of the expansion turbine without passing through the exchange line.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DESCRIPTION OF PREFERRED EMBODIMENTS

Figure 1:
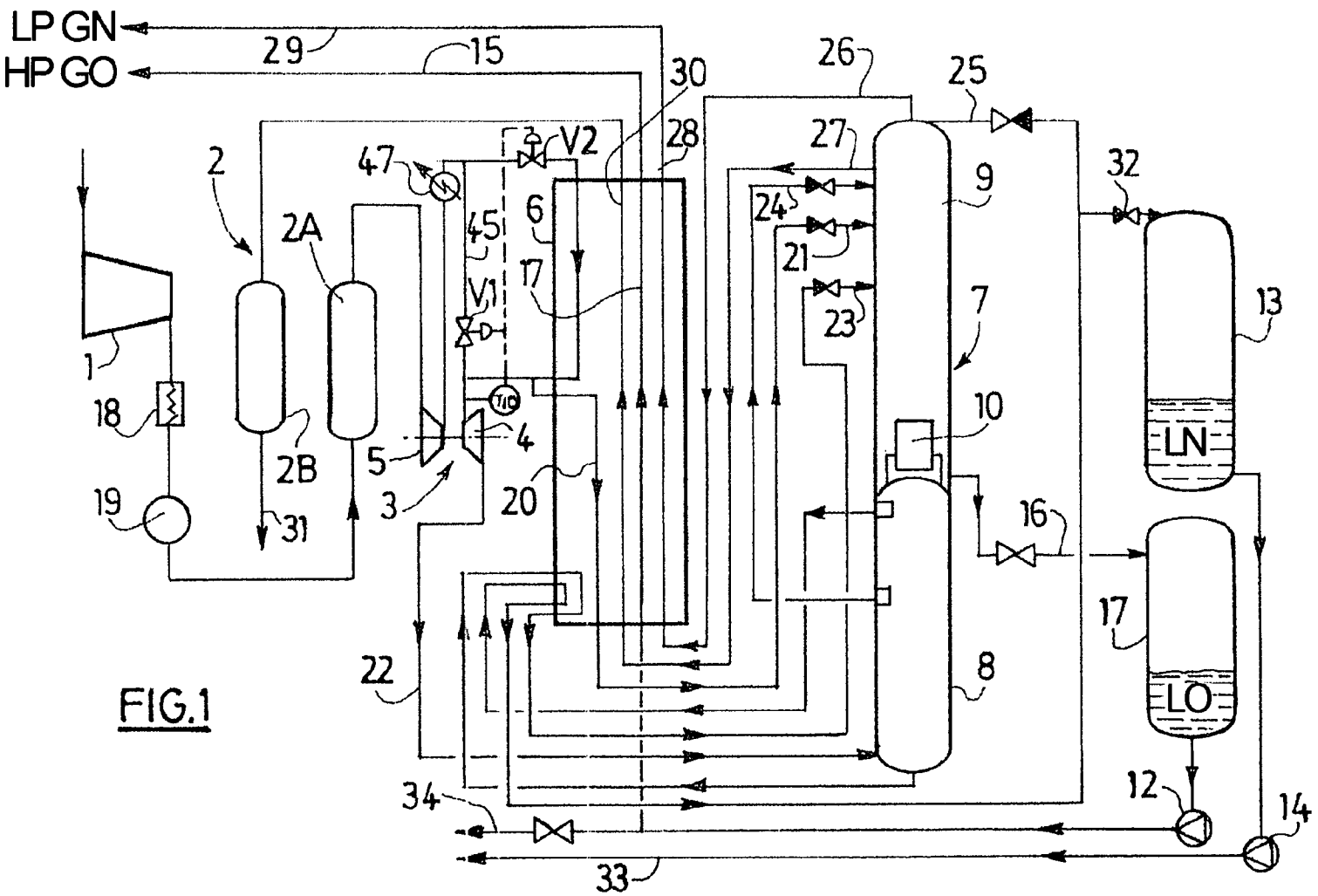
FIG. 1 illustrates one embodiment of the invention wherein high pressure gaseous oxygen is produced.

The word "oxygen" covers fluids containing at least 60 mol % oxygen, in preference at least 80 mol % oxygen, the word "argon" covers fluids containing at least 90 mol % argon, in preference at least 95 mol % argon and the word "nitrogen" covers fluids containing at least 80 mol % nitrogen, in preference at least 90 mol % nitrogen.

According to other optional features:

- at least one portion of the air in the process of cooling in the heat exchange line is extracted from the latter at an intermediate temperature of the exchange line;
- the said fluid in the liquid state is brought to the high pressure between 5 and 50 bar, in preference between 10 and 50 bar;
- the air is supercharged at the intermediate temperature in a cold blower to the high pressure;
- the supercharged air is reintroduced into the heat exchange line;
- a first portion of the supercharged air is sent into one column of the system of columns and a second portion of the supercharged air is sent into an expansion turbine, the expanded air then being sent into one column of the system of columns;

during start-up of the installation and/or when the inlet temperature of the turbine falls below a predetermined threshold and/or during a change of operation, at least one portion of the air extracted from the exchange line and supercharged in the cold blower is sent upstream of the expansion turbine without passing through the exchange line;

all the incoming air in the process of cooling is extracted, is supercharged in the cold blower and reintroduced into the exchange line;

during start-up of the installation, all the air extracted from the exchange line and supercharged in the cold blower is sent upstream of the expansion turbine without passing through the exchange line;

when the temperature of the air supercharged in the cold blower is reduced to a predetermined temperature or after a predetermined time, no more supercharged air is sent upstream of the expansion turbine without passing through the exchange line;

the inlet temperature of the cold blower is lower than the inlet temperature of the expansion turbine;

at least one portion of the air is compressed to the high pressure, the air at the high pressure is sent into the hot end of the exchange line, a portion of the air is extracted from the exchange line at an intermediate temperature and expanded in the turbine and the rest of the air continues its cooling in the exchange line and in which, during start-up of the installation and/or if the inlet temperature of the turbine falls below a predetermined threshold and/or in the event of a change of operation, air is sent directly from the supercharger into the inlet of the turbine without having been cooled in the exchange line;

all the air is compressed in the compressor and the supercharger to the high pressure; and only a portion of the air is supercharged in a supercharger to the high pressure.

It is another object of the invention to provide a method of producing, in gaseous form and under high pressure, at least one fluid chosen from oxygen, argon and nitrogen, in which method, in stable operation, air is compressed in a compressor, the compressed air is purified and sent into a heat exchange line of the installation in which it is cooled, the compressed, purified and cooled air is separated in a system of columns of the installation comprising at least one distillation column, a fluid is withdrawn in the liquid state from one column of the system of columns, the said fluid is brought in the liquid state to the high pressure, vaporized by heat exchange with air and the vaporized liquid is warmed at this high pressure in the heat exchange line of the installation:

a flow of compressed nitrogen in the process of cooling in the heat exchange line is extracted from the latter at an intermediate temperature of the exchange line;

the nitrogen is supercharged at the intermediate temperature in a cold blower up to the first pressure;

the supercharged nitrogen is reintroduced into the heat exchange line;

a first portion of the supercharged nitrogen is sent into one column of the system of columns and a second portion of the supercharged nitrogen is sent into an expansion turbine, the expanded nitrogen then being sent into one column of the system of columns;

characterized in that, during start-up of the installation and/or when the inlet temperature of the turbine falls below a predetermined threshold and/or during a change of operation, at least one portion of the nitrogen extracted from the exchange line and supercharged in the cold blower is sent upstream of the expansion turbine without passing through the exchange line.

It is another object of the invention to provide an installation for producing, in gaseous form and under high pressure, at least one fluid chosen from oxygen, argon and nitrogen, of the type comprising a system of air distillation columns, a supercharger to supercharge at least one portion of the supply air or of cycle gas up to a high pressure, a heat exchange line bringing the incoming air and the fluids withdrawn from the system of columns, including the said fluid(s) in liquid form withdrawn from the distillation unit and compressed by a pump, into heat exchange relationship and a turbine the inlet of which is linked to the outlet of the supercharger by means that pass through the heat exchange line and is characterized in that the turbine inlet is also linked to the outlet of the supercharger by means that do not pass through the heat exchange line.

According to other optional aspects, the installation comprises:

a cold blower, means for supplying this cold blower with air or a cycle gas in the process of cooling taken at an intermediate temperature level from the heat exchange line, means for reintroducing the supercharged air or the supercharged cycle gas into passages of the heat exchange line that are linked to the turbine, the turbine inlet also being linked to the outlet of the cold blower by means that do not pass through the heat exchange line;

means for sending all the air intended to be distilled to the cold blower;

means for detecting the temperature of the air or of the cycle gas entering the turbine or leaving the cold blower upstream of the heat exchange line;

means for opening and closing the lines linking the inlet of the turbine with the outlet of the cold blower while passing through the passages of the exchange line and without passing through the passages of the exchange line;

the turbine inlet is linked to the outlet of the cold blower by means that do not pass through the heat exchange line and that do not comprise cooling means; and means for compressing all or some of the air intended for distillation to the high pressure upstream of the exchange line and means for sending the air at the high pressure from the supercharger as far as the hot end of the exchange line.

If a hot supercharger is used, in preference the turbine inlet and the supercharger outlet are linked via cooling means.

The air sent into the supercharger may consist of at least one portion of the incoming air in the process of cooling.

Optionally:

the said cycle gas consists of nitrogen reintroduced into the heat exchange line, which is extracted from the latter at an intermediate temperature below the inlet temperature of the turbine;

moreover, oxygen, argon or nitrogen is produced at an intermediate pressure by pumping and vaporization-warming in the heat exchange line, the intermediate pressure allowing vaporization by condensation of a gas flowing in this heat exchange line.

It is another object of the invention to provide a method of producing, in gaseous form and under high pressure, at least one fluid chosen from oxygen, argon and nitrogen, in which, in stable operation, air is compressed in a compressor, the compressed air is purified and sent into a heat exchange line of the installation in which it is cooled, the compressed, purified and cooled air is separated in a system of columns of the installation comprising at least one distillation column, a fluid is withdrawn in the liquid state from one column of the system of columns, the said fluid in the liquid state is brought to the high pressure, vaporized by heat exchange with air and the vaporized liquid at this high pressure is warmed in the heat exchange line of the installation:

- at least one portion of the air in the process of cooling in the heat exchange line is extracted at an intermediate temperature from the latter;
- the air is supercharged at the intermediate temperature in a cold supercharger;
- the supercharged air is reintroduced into the heat exchange line; and
- a first portion of the supercharged air is sent into one column of the system of columns and a second portion of the supercharged air is sent into an expansion turbine, the expanded air then being sent into one column of the system of columns;

characterized in that all the air intended for distillation is supercharged in the cold supercharger.

In preference, the inlet temperature of the turbine is hotter than the inlet temperature of the cold supercharger.

Figure 2:
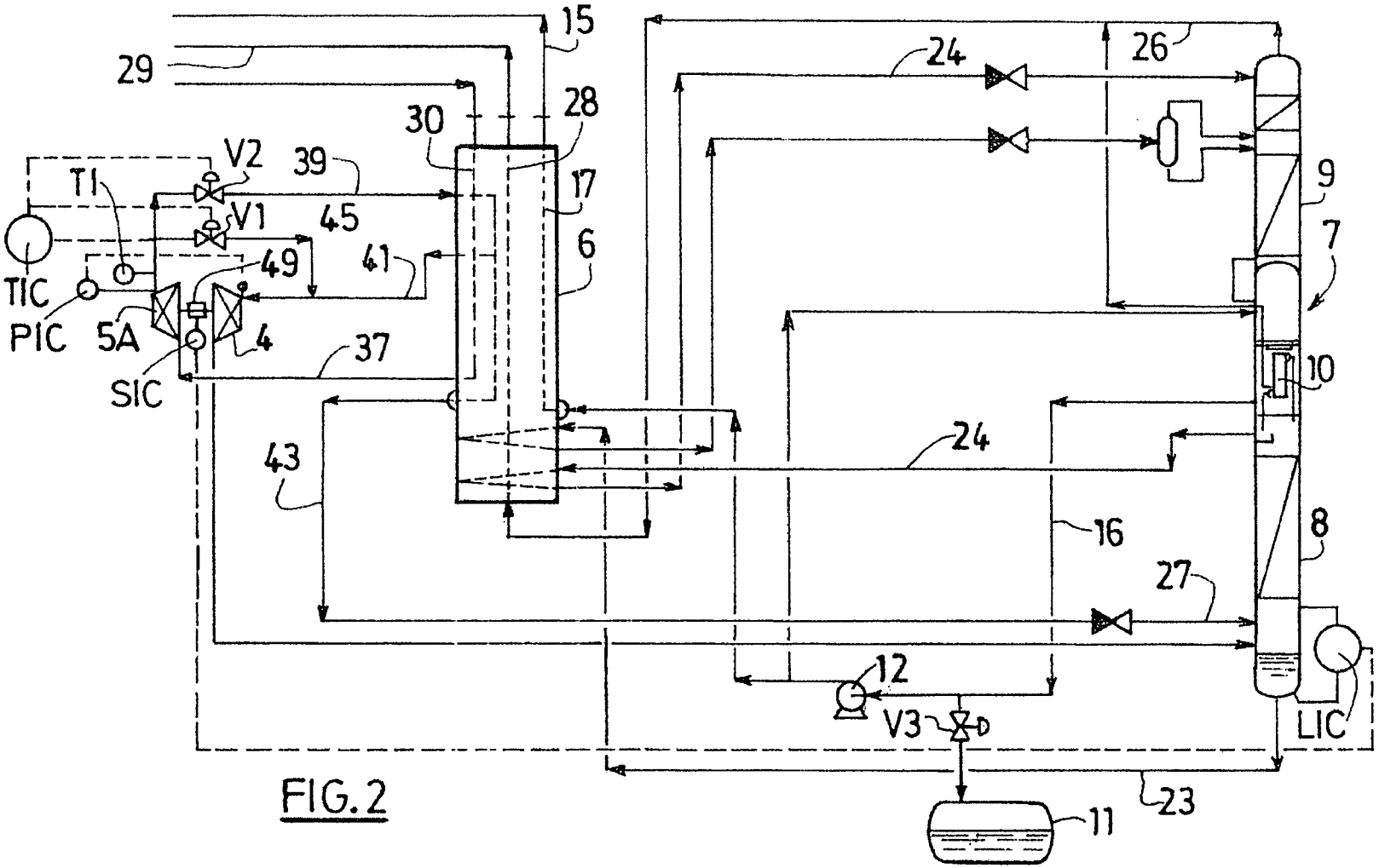
FIG. 2 illustrates a second embodiment of the invention wherein high pressure gaseous oxygen is produced.
Figure 3:
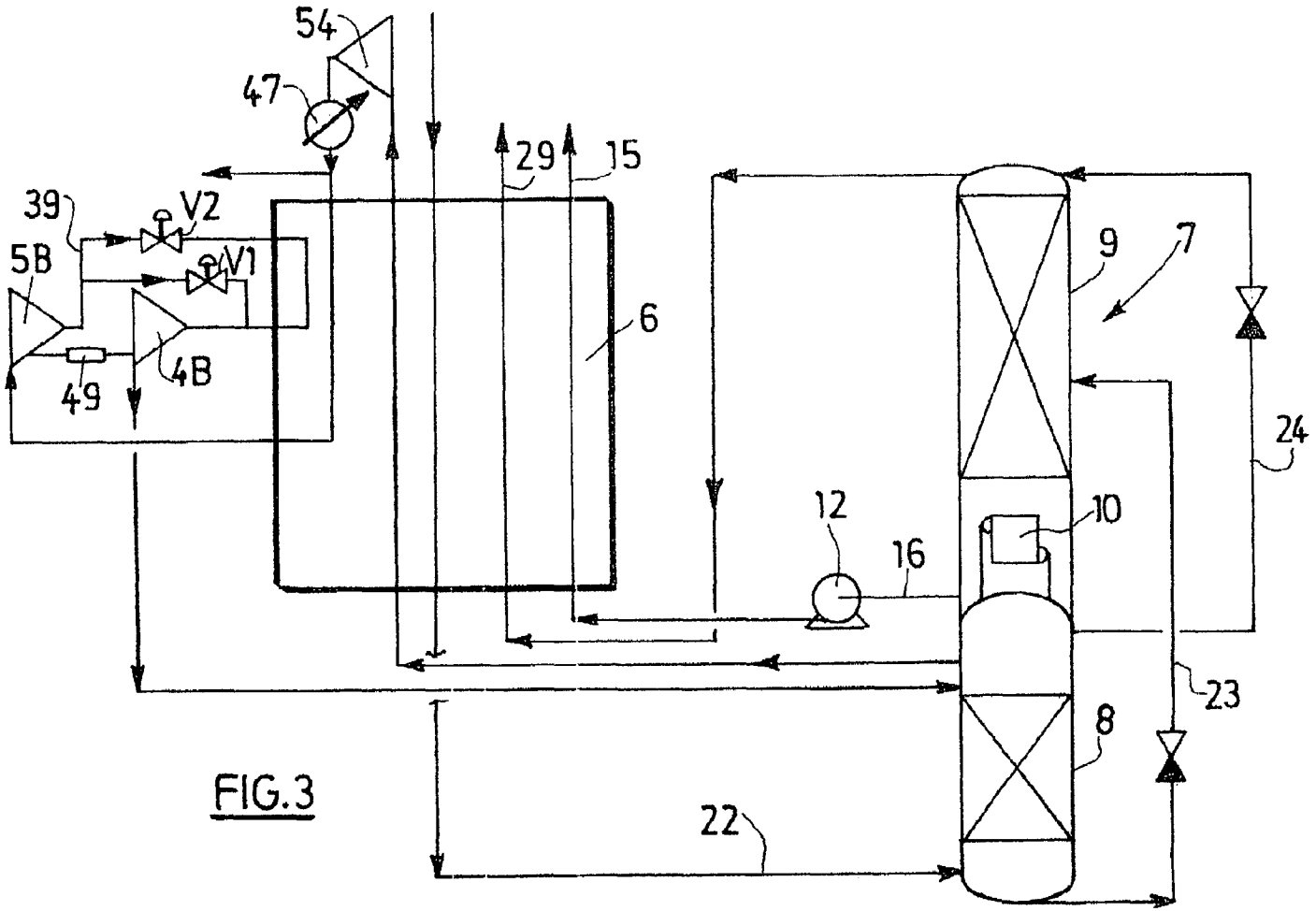
FIG. 3 illustrates a third embodiment of the invention wherein medium pressure nitrogen is produced.

Exemplary embodiments of the invention will now be described with regard to the appended drawings, in which FIGS. 1, 2 and 3 schematically represent installations for producing gaseous oxygen under pressure according to the invention.

The air distillation installation represented in FIG. 1 comprises essentially an air compressor 1, an air purification unit 2, a turbine-supercharger set 3, comprising an expansion turbine 4 and a supercharger 5 the shafts of which are coupled together, a heat exchanger 6 constituting the heat exchange line of the installation and of which the cold portion serves as a subcooler; a double distillation column 7 comprising a medium-pressure column 8 and a low-pressure column 9, with a condenser-reboiler 10 bringing the overhead gas from the medium-pressure column and the bottom liquid from the low-pressure column into heat exchange relationship; a liquid oxygen tank 1 the bottom of which is linked to a pump 12; and a liquid nitrogen tank 13 the bottom of which is linked to a pump 14.

This installation is intended to deliver, via a line 15, gaseous oxygen under high pressure, which may be between 5 and 50 bar abs, in preference between 10 and 50 bar abs.

For this, the liquid oxygen withdrawn from the bottom of the column 9, via a line 16, and stored in the tank 11, is brought to the high pressure by the pump 12 in the liquid state, then vaporized and warmed at this high pressure in passages 17 of the exchanger 6.

All the air to be distilled is compressed by the compressor 1 to a pressure higher than the pressure of the medium-pressure column 8 but lower than the high pressure. Then the air precooled at 18 and cooled to close to ambient temperature at 19 is purified in one of the adsorption bottles and all supercharged to the high pressure by the supercharger 5, which is driven by the turbine 4.

All the supercharged air is cooled by a water cooler 47 and in normal operation sent through the valve V2, which is open, to the hot end of the exchanger 6, the valve V1 remaining closed. The air is cooled in the exchanger 6 and a portion of the air at an intermediate temperature is expanded in the turbine 4 before being sent into the medium-pressure column 8. The rest of the air is cooled in the exchanger 6 as far as the cold end and is sent into the low-pressure column and/or to the medium-pressure column.

If the inlet or outlet temperature of the turbine 4 becomes too low following the start-up or a change of operation, the valve V1 is opened, and at least one portion of the supercharged and cooled air passes directly to the inlet of the turbine 4 without passing via the exchanger 6. This prevents damaging the turbine.

Once the temperature of the turbine has been re-established, the valve V1 closes again and all the air passes to the hot end of the exchanger.

The installation represented in FIG. 2 is intended to produce gaseous oxygen under high pressure, for example between 10 and 50 bar, in particular around 40 bar. It comprises essentially a double distillation column 7 consisting of a medium-pressure column 8, operating at approximately 6 bar, and a low-pressure column 9, operating under a pressure slightly higher than 1 bar, a heat exchange line 6, into which a subcooler is integrated at the cold end, a liquid oxygen pump 12, a cold blower 5A and a turbine 4 the rotor of which is mounted on the same shaft as that of the cold blower and of an oil brake 49.

Recognizable in the drawing are the conventional lines of the double column, that is a line 23 for "rich liquid" (air enriched with oxygen) collected in the bottom of the column 8 which rises to an intermediate point of the column 9, after subcooling at 6 and expansion to the low pressure in an expansion valve; a line 24 for "lean liquid" (almost pure nitrogen) withdrawn from the top of the column 8, which liquid rises to the top of the column 9, after subcooling at 6 and expansion to the low pressure in an expansion valve, and a line 26 for production of impure nitrogen, constituting the waste gas of the installation, this line passing through the subcooler at 6 then connecting to nitrogen warming passages 28 of the exchange line 6. The impure nitrogen thus warmed to ambient temperature is discharged from the installation via a line 29.

The pump 12 draws in the liquid oxygen under approximately 2 bar originating from the bottom of the column 9, takes it to a pressure higher than the desired production pressure, for example 40 bar, and introduces it into oxygen vaporization-warming passages 17 of the exchange line.

The air to be distilled, compressed, cooled and purified in conventional manner, arrives at approximately 16.5 bar via a line and enters air cooling passages 30 of the exchange line 6.

In stable operation, a portion of this air at an intermediate temperature T1, less than ambient temperature and close to the oxygen vaporization temperature VT (or pseudo-vaporization temperature if the production pressure of the oxygen is supercritical), is extracted from the exchange line via a line 37 and brought to the intake of the cold blower 5A. The latter takes this air to 26 bar and, via a line 39, the air thus supercharged is returned to the exchange line 6, at a temperature T2 higher than T1, and continues its cooling in supercharged-air passages of the latter. A portion of the air carried by the passages is again extracted from the exchange line at a second intermediate temperature T3 higher than T1 via the line 41 and expanded to medium pressure (6 bar) in the turbine 4. The air in two-phase form that escapes from this turbine may be sent into a phase separator or is sent directly to the bottom of column 8.

The air conveyed by the line 43 and not diverted by the line 41 continues its cooling in the exchange line and leaves it upstream of the subcooler. It is then expanded to the medium pressure in an expansion valve 27 and sent into the distillation columns, in particular to the bottom of the column 8. The blower 5A that performs the supercharging is driven by the turbine 4, so that no external energy is necessary. The amount of refrigeration produced by this turbine may be slightly greater than the heat of compression, and the excess amount helps to keep the installation in refrigeration. The remainder or all of the refrigeration may be supplied by expansion of air or nitrogen to the medium pressure in another turbine (not illustrated).

As a further variant, the or each cold blower may compress a gas other than the air flowing in the heat exchange line, in particular the cycle nitrogen previously warmed up to ambient temperature, compressed and in the process of cooling.

Here the installation produces liquid oxygen in the tank 11.

The installation comprises a valve V1 in a line 45 linking the outlet of the blower 5A and the line 41 bringing the air to the inlet of the turbine 4 and a valve V2 in the line 39 linking the outlet of the blower 5A and the inlet of the exchanger of the line 39.

At start-up of the installation, the air to be distilled arrives at approximately 16.5 bar and enters air cooling passages 30 of the exchange line.

The air (or where necessary a portion of the air) is extracted from the exchange line via a line 37 at a temperature which may reach 90° C. and is brought to the intake of the cold blower 5A. The latter supercharges this air to between 20 and 26 bar and a temperature that may reach as high as is 120° C., the valve V1 being open and the valve V2 closed, the compressed air is sent via the lines 45, 41 directly to the inlet of the turbine 4 without cooling in the exchange line 6. The expanded air is then sent into the bottom of the medium-pressure column 8. Alternatively or additionally, at the start of operation, temperature measurement means detect whether the inlet temperature of the turbine 4 and/or the temperature at the outlet of the blower of the air originating from the blower 5A falls below a predetermined threshold and, if the temperature is low enough, the valve V2 opens and the valve V1 closes so that the supercharged air at 5A is sent into the line 39, then to the exchange line 6, before being divided into two and sent in part to the turbine 4 and in part to the bottom of the medium-pressure column 8. This arrangement of the valves corresponds to the stable operation.

Alternatively, the closure of the valve V1 and the opening of the valve V2 may be initiated a certain time after the primary compressor is started up.

The valves V1, V2 may also have the same operation as in FIG. 1, that is, if the inlet temperature of the turbine and/or the outlet temperature of the blower become (becomes) too low, hot air can be sent into the turbine by opening the valve V1 so that the air passes directly from the blower to the turbine through the line 45.

Control of the bottom level (LIC) of the medium-pressure column 8 or the low-pressure column 9 can be achieved by acting on the speed of the turbine 4 via an SIC (speed indicator and controller). The speed of rotation may also be set so that the installation operates with excess cooling power. The excess refrigeration is eliminated by any liquid line (nitrogen, oxygen or argon line) of the cold box, for example by opening the valve V3. The liquid line must have an automatic valve the opening and closing of which are linked to bottom level thresholds of the low-pressure column 9.

As described in U.S. Pat. No. 5,475,980, the Claude turbine 4, and possibly the cold blower 5A, may be coupled to an energy adsorption device other than an oil brake 49, such as an alternator or a generator.

The examples in FIGS. 1 and 2 describe the vaporization of oxygen in the exchange line but the invention applies equally to cases in which liquid nitrogen or liquid argon vaporizes in the exchange line instead of or with the liquid oxygen.

The invention applies equally to the case in which only a portion of the air is supercharged as is seen in FIGS. 6, 8, 10 and 11 of EP 504 029 and in EP-A-0 644 388 and FR-A-2 688 052.

In FIG. 3, a medium-pressure nitrogen cycle supplies the refrigeration required for the separation.

The liquid upflows 23, 24 into and the production streams 15, 29 of the low-pressure column 9 are identical to those previously described.

Air compressed to the medium pressure is purified and then cools in the exchange line 6 before being sent into the medium-pressure column 8.

Medium-pressure nitrogen is withdrawn from the top of the medium-pressure column 8, warmed in the exchange line 6 as far as the hot end and then compressed in a compressor 54. Some or all of the compressed nitrogen is cooled by a cooler 47 and re-enters the exchange line.

The nitrogen returned to the exchange line leaves the latter at an intermediate temperature to be supercharged in a supercharger 5B coupled to the same shaft as a turbine 4B.

In normal operation, a valve V2 is open in a line 39 that brings the supercharged nitrogen into the exchange line, where it is cooled, and the valve V1 in a line 45 is closed.

At the moment of start-up and/or during changes of operation and/or to regulate the inlet temperature of the turbine, the valve V1 opens and the valve V2 closes so that the nitrogen compressed in the supercharger 5B arrives at the inlet of the turbine 4B without having been cooled in the exchange line. It is also possible to adjust the valves so that a portion of the supercharged nitrogen arrives at the inlet of the turbine after cooling in the exchange line, whereas the rest of the supercharged nitrogen arrives at the inlet of the turbine 4B without cooling.

The system of columns may comprise a single column, a double column or a triple column with or without an argon mixture column, a mixing column or any other type of column for separating an air gas.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method of producing, in gaseous form and under high pressure, at least one fluid chosen from oxygen, argon and nitrogen, in which method, in stable operation, the air is compressed in a compressor, the compressed air is purified and sent into a heat exchange line of the installation in which it is cooled, the compressed, purified and cooled air is separated in a system of columns of the installation comprising at least one distillation column, a fluid is withdrawn in the liquid state from one column of the system of columns, the said fluid in the liquid state is brought to the high pressure, vaporized by heat exchange with air and the vaporized liquid is warmed at this high pressure in the heat exchange line of the installation:

a) a flow of compressed nitrogen in the process of cooling in the heat exchange line is extracted from the latter at an intermediate temperature of the exchange line;

b) the nitrogen is supercharged at the intermediate temperature in a cold blower up to the high pressure;

c) the supercharged nitrogen is reintroduced into the heat exchange line;

d) at least a portion of the supercharged nitrogen is sent into an expansion turbine, the expanded nitrogen then being sent into one column of the system of columns, wherein, during start-up of the installation and/or when the inlet temperature of the turbine inlet falls below a predetermined threshold and/or during a change of operation, at least one portion of the nitrogen extracted from the exchange line and supercharged in the cold blower is sent upstream of the expansion turbine without passing through the exchange line.

2. An apparatus for producing in gaseous form and under high pressure at least one fluid, the apparatus comprising:

a system of air distillation columns;

a compressor having a compressor inlet and compressor outlet, wherein the compressor pressurizes at least one portion of an supply air or a cycle gas up to a high pressure;

a heat exchanger having a plurality of heat exchange lines fluidly coupled to the system of air distillation columns and the compressor, wherein at least one of the plurality of heat exchange lines transporting the supply air or cycle gas from the compressor and at least one of the plurality of heat exchange line transporting one or more fluids withdrawn from the system of columns are in heat exchange relationship; and a turbine having a turbine inlet and turbine outlet, and the turbine is fluidly coupled to the compressor, wherein the turbine inlet is fluidly coupled to the outlet of the compressor by means that pass through at least one of the heat exchange lines, the turbine inlet is fluidly coupled to the compressor by means that do not pass through the heat exchanger, and the turbine outlet is coupled to the system of air distillation columns by means that do not pass through the heat exchanger.

3. An apparatus for producing, in gaseous form and under high pressure at least one fluid, the apparatus comprising:

a system of air distillation columns;

a first compressor means having an inlet and an outlet, and the first compressor means pressurizes a supply air to a high pressure;

a turbine having an inlet and an outlet;

a heat exchanger having a plurality of heat exchange lines fluidly coupled to the system of air distillation columns, the first compressor means, and the turbine, wherein at least one of the plurality of heat exchange lines transporting the supply air from the compressor and the turbine, and at least one of the plurality of heat exchange line transporting one or more fluids withdrawn from the system of columns are in a heat exchange relationship;

a second compressor means having an inlet and an outlet and adapted to withdraw for the compressed supply air at an intermediate temperature level from at least one of the heat exchange lines and further pressurizes the compressed supply air to produce further compressed supply air; and means for reintroducing the further compressed supply air from the second compressor means into at least one heat exchange line coupled to the turbine, wherein the turbine inlet is fluidly coupled to the outlet of the second compressor means by means that pass through at least one of the heat exchange lines and by means that do not pass through at least one of the heat exchange lines.

4. The apparatus of claim 3, further comprising means for sending all the air intended to be distilled to the second compressor means.

5. An apparatus for producing, in gaseous form and under high pressure at least one fluid, comprising:

a system of air distillation columns;

a first compressor means having an inlet and an outlet, and the first compressor means pressurizes a supply air to a high pressure;

a turbine having an inlet and an outlet;

a heat exchanger having a plurality of heat exchange lines fluidly coupled to the system of air distillation columns, the first compressor means, and the turbine, wherein at least one of the plurality of heat exchange lines transporting the supply air from the first compressor means and the turbine, and at least one of the plurality of heat exchange lines transporting one or more fluids withdrawn from the system of air distillation columns are in heat exchange relationship; and a second compressor means having an inlet and an outlet and adapted to withdraw a compressed supply air at an intermediate temperature level from at least one of the heat exchange lines and further pressurizes the compressed supply air to produce further compressed supply air;

means for reintroducing the further compressed supply air into at least one heat exchange line coupled to the turbine, wherein the turbine inlet is fluidly coupled to the outlet of the second compressor means by means that pass through at least one of the heat exchange lines and by means that do not pass through at least one of the heat exchange lines, wherein the apparatus further comprises means for detecting the temperature of the air or of the cycle gas leaving the second compressor means upstream of the heat exchange line.

6. The apparatus of claim 3, further comprising means for opening and closing the fluid coupling between the turbine inlet second compressor means outlet for means that pass through at least one of the heat exchange lines for means that do not pass through at least one of the heat exchange lines.

7. The apparatus of claim 3, wherein the turbine inlet is fluidly coupled to the second compressor means outlet by means that do not pass through at least one of the heat exchange lines and that do not comprise cooling means.

8. An apparatus for producing, in gaseous form and under high pressure at least one fluid comprising:

a system of air distillation columns;

a compressor having a compressor inlet and compressor outlet, wherein the compressor pressurizes at least one portion of a supply air or a cycle gas up to a high pressure;

a heat exchanger having a plurality of heat exchange lines fluidly coupled to the system of air distillation columns and the compressor, wherein at least one of the plurality of heat exchange line transporting the supply air or cycle gas from the compressor and at least one of the plurality of heat exchange lines transporting one or more fluids withdrawn from the system of columns are in a heat exchange relationship; and a turbine having a turbine inlet and turbine outlet, and the turbine inlet is fluidly coupled to the outlet of the compressor by means that pass through at least one of the heat exchange lines, the turbine inlet is fluidly coupled to the compressor by means that do not pass through the heat exchanger, and the turbine outlet is coupled to the system of air distillation columns by means that do not pass through the heat exchanger, and further comprising means for compressing all or some of the air intended for distillation at the high pressure upstream of at least one of the exchange lines and means for sending the air at the high pressure from the compressor as far as a near end of the at least one of the exchange lines from the compressor.

9. The apparatus of claim 8, wherein the turbine inlet and the compressor outlet are linked via cooling means.

10. The method of claim 1, wherein the high pressure is between 5 bar and 50 bar.

11. A method, comprising:

compressing an air in a first compressor;

purifying the compressed air;

cooling the compressed air;

sending the compressed air at a first temperature into a heat exchange line of a heat exchanger;

processing a portion of compressed air, comprising:

extracting the portion of the compressed air from an intermediate portion of the heat exchange line having a second temperature less than the first temperature;

compressing the portion of the compressed air to a high pressure;

reintroducing the high pressure compressed air into the heat exchanger;

withdrawing a portion of the high pressure compressed air from the heat exchanger;

expanding the portion of the high pressure compressed air in a turbine having a turbine inlet and a turbine outlet; and forwarding the expanded portion of high pressure compressed air to at least one distillation column of a system of columns; and separating the compressed air in at least one distillation column of a system of columns;

withdrawing a fluid in the liquid state from one column of the system of columns;

pressurizing the fluid in the liquid state to a high pressure;

vaporizing and warming the fluid in a heat exchange line; and wherein when an inlet temperature of the turbine inlet falls below a predetermined threshold, at least a portion of the high pressure compressed air is sent upstream of the expansion turbine without passing through the heat exchange line.

12. The method of claim 11, wherein the high pressure is between 5 bar and 50 bar.

13. The method of claim 11, wherein the at least one fluid is selected from the group consisting of oxygen, argon and nitrogen.

14. The apparatus of claim 2, wherein the high pressure is between 5 bar and 50 bar.

15. The apparatus of claim 2, wherein the at least one fluid is selected from the group consisting of oxygen, argon and nitrogen.

16. The apparatus of claim 3, wherein the high pressure is between 5 bar and 50 bar.

17. The apparatus of claim 3, wherein the at least one fluid is selected from the group consisting of oxygen, argon and nitrogen.

18. The apparatus of claim 5, wherein the high pressure is between 5 bar and 50 bar.

19. The apparatus of claim 5, wherein the at least one fluid is selected from the group consisting of oxygen, argon and nitrogen.

20. The apparatus of claim 8, wherein the high pressure is between 5 bar and 50 bar.

21. The apparatus of claim 8, wherein the at least one fluid is selected from the group consisting of oxygen, argon and nitrogen.

* * * * *